US006117236A

United States Patent [19]

Ruschak et al.

[11] Patent Number: 6,117,236

[45] Date of Patent: Sep. 12, 2000

[54] CURTAIN COATING APPARATUS AND METHOD WITH CONTINUOUS WIDTH ADJUSTMENT

[75] Inventors: Kenneth J. Ruschak; Jeffrey K. Kroon, both of Rochester; David A. Wakefield, Canandaigua, all of N.Y.

[73] Assignee: Eastman Kodak Company, Rochester, N.Y.

[21] Appl. No.: 09/040,868

[22] Filed: Mar. 18, 1998

[51] Int. Cl.[7] ..... B05C 5/00; B05D 1/30; B05D 1/36; B05D 7/24

[52] U.S. Cl. ..... 118/300; 118/324; 118/325; 118/DIG. 4; 427/294; 427/420

[58] Field of Search ..... 118/300, 324, 118/325, DIG. 4; 427/294, 420

[56] References Cited

U.S. PATENT DOCUMENTS

| | | | |
|---|---|---|---|
| 3,205,089 | 9/1965 | Kinzelman | 117/103.3 |
| 3,359,941 | 12/1967 | Sible | 118/301 |
| 3,508,047 | 4/1970 | Hughes | 117/34 |
| 4,060,649 | 11/1977 | Coleman | 427/79 |
| 4,384,015 | 5/1983 | Koepke et al. | 427/402 |
| 4,559,896 | 12/1985 | Bossard et al. | 118/300 |
| 4,830,887 | 5/1989 | Reiter | 427/420 |
| 4,879,968 | 11/1989 | Denx et al. | 118/300 |
| 4,975,304 | 12/1990 | Kawahara et al. | 427/264 |
| 5,298,288 | 3/1994 | Curry, II et al. | 427/379 |
| 5,328,726 | 7/1994 | Reiter | 427/420 |
| 5,358,569 | 10/1994 | Conroy et al. | 118/324 |
| 5,395,660 | 3/1995 | Ruschak et al. | 427/420 |
| 5,462,598 | 10/1995 | Servant et al. | 118/324 |
| 5,725,910 | 3/1998 | Devine et al. | 427/420 |

FOREIGN PATENT DOCUMENTS

| | | | |
|---|---|---|---|
| 0 530 751 A1 | 3/1993 | European Pat. Off. | G03C 1/74 |
| 0 636 423 A1 | 2/1995 | European Pat. Off. | B05C 5/00 |
| 61-477 | 1/1986 | Japan | B05C 5/00 |
| 90/00939 | 2/1990 | WIPO | B05C 5/00 |

OTHER PUBLICATIONS

European Patent Office Communication, dated Aug. 12, 1999, containing the European search report.

*Primary Examiner*—Laura Edwards
*Assistant Examiner*—J. A. Lorengo
*Attorney, Agent, or Firm*—Mark G. Bocchetti

[57] ABSTRACT

An inexpensive and versatile method for creating a curtain of continuously adjustable width for the purpose of coating portions of a receiving surface to form one or more layers of coating composition comprises a distributor which has a horizontal lip from which the layers detach to form a free-falling curtain. A trough adjacent and below the lip is provided to intercept and divert some portion of the curtain and an edge guide is provided to maintain the width of the remaining portion of the free-falling curtain.

13 Claims, 3 Drawing Sheets

CURTAIN COATING APPARATUS AND METHOD WITH CONTINUOUS WIDTH ADJUSTMENT

FIELD OF THE INVENTION

The invention relates to a coating method or to a feed for a coating method. More particularly, the invention addresses the creation of a free-falling curtain of continuously adjustable width for application to a receiving surface, such as photographic film or paper.

BACKGROUND OF THE INVENTION

A known way to apply coatings to a receiving surface is to use a distributor to form a layer of coating composition that flows off a horizontal lip of the distributor to create a free-falling curtain of coating composition and to pass the receiving surface through this curtain. The coating composition accelerates by gravity in the curtain, and the increased speed of impingement facilitates higher coating speeds without entraining air. Irregularly shaped objects may be passed through a curtain without breaking it. The small gap between the distributor and the receiving surface required by many coating methods incurs practical disadvantages obviated by curtain coating.

A difficulty in curtain coating is maintaining the width of the free-falling curtain between the lip of the distributor and the receiving surface. Without intervention, a curtain narrows with distance from the lip because of surface tension. A vertical solid surface wetted by the edge of the curtain supports surface tension and maintains curtain width between the lip and receiving surface but may introduce difficulties. Such edge guides exert drag on the coating composition so that an edge portion of the curtain impinges on the receiving surface at a lower speed than the main body of the curtain, and the edge of the curtain may fail to coat. Curved menisci at the edge guide alter the flow distribution locally and thereby create coating nonuniformities. Some coating compositions build up on the edge guide over time. Fouling, surface imperfections, or abrupt changes in geometry of the edge guide produce waves in the curtain that alter coating uniformity up to several inches from the edge guide.

For much of the history of curtain coating, problems at edges have been avoided by forming a curtain wider than the receiving surface, as shown in FIG. 1(*a*). Indeed, a curtain of sufficient width can have unguided edges and still exceed the width of the receiving surface. In most applications, the curtain consists of a single coating composition, and so the portion of the curtain outside the receiving surface can usually be collected and recycled. In simultaneous multilayer coating, recycling is not possible, and sometimes edge curtains of less costly composition are formed contiguous with the main body of the curtain to reduce the cost of wasted materials.

The biggest disadvantage of a curtain that is wider than the receiving surface is that the entire receiving surface must be coated even though complete coverage is unnecessary or inconsistent with the features of the product. Edge portions of the receiving surface may intentionally differ from the main portion so that an applied coating is wasted; for instance, the edges of a continuous receiving surface may be knurled to aid the winding of rolls of support. The coating composition may wet around the edges of the receiving surface and foul subsequent surfaces of contact.

Many ways to prevent coating of portions of the receiving surface are taught in the art. The edges of the support might be folded downward, as shown in FIG. 1(*b*) and taught in U.S. Pat. No. 4,975,304, but many receiving surfaces do not have the required flexibility, resiliency, and strength. Several ways are taught for shielding portions of the receiving surface. A simple pan, as shown in FIG. 1(*c*) and taught in U.S. Pat. No. 3,359,941, does not efficiently evacuate the impinging coating composition, and increasing the height of the walls of the pan introduces the problems of edge guides recited previously. Evacuation can be improved by covering the surface of the pan or blade with a fast moving film of low viscosity liquid, as shown in FIG. 1(*d*) and taught in International Publication Number WO 90/01179, but the intercepted coating composition is wasted. Disclosed edge guides that deflect part of the curtain, as shown in FIG. 1(*e*) and taught in U.S. Pat. No. 4,559,896, or as shown in FIG. 1(*f*) and taught in U.S. Pat. No. 4,879,968, suffer from the known problems of edge guides recited previously; the curtain is guided by a surface that greatly exceeds curtain thickness. This art also teaches the step of significantly angling the edge guide in a vertical plane passing through the lip to widen or narrow the curtain and alter the uniformity of the coating near the edge. Such a step is damaging when the objective is coating a layer uniform to its edges.

However, there are edge guides that avoid most or all of the typical problems. Depending upon the demands of the application, these guides involve some or all of the steps of minimizing the wetted surface area of the edge guide to reduce drag; minimizing the thickness of the edge guide to maintain the two surfaces of the curtain substantially planar and thereby avoid the redistribution of coating composition caused by curved menisci; flushing the guide with a liquid substantially lower in viscosity than the coating composition to reduce drag and prevent fouling; and intercepting and efficiently evacuating a small portion of the curtain adjacent to the edge guide immediately above the receiving surface to minimize excess thickness of the edges of the coating without compromising coating latitude. A guide of suitably small surface area and thickness consists of two thin, smooth, parallel, and closely spaced wires under tension lying in a vertical plane perpendicular to the lip (U.S. Pat. No. 4,830,887). An air flow created by a vacuum source, guided and supported by a blade immediately below the edge guide and above the receiving surface, is effective at removing any lubricating liquid and an adjacent, nonuniform portion of the curtain without reintroducing the problems of edge guides (U.S. Pat. No. 5,395,660).

Besides keeping some portions of the receiving surface dry, it is also sometimes desirable to change the widths of the coated areas without replacing the distributor or altering or replacing some of its elements and perhaps without stopping the process. Continuously variable coating width might replace or augment the steering of the receiving surface to obtain precise registration of the coating; poor registration might be inherently unacceptable or require in compensation wider coating and receiving surfaces than otherwise necessary.

SUMMARY OF THE INVENTION

Accordingly, an object of the invention is to provide an inexpensive and effective method for continuously and substantially varying coating width in curtain coating. It is furthermore an object of the invention to accomplish variable coating width without replacing or altering the distributor. The invention is particularly advantageous for the coating of a single coating composition that can be recycled. Further objects and advantages of the invention will become apparent from a detailed consideration of the drawings and ensuing description.

One of several distributors known in the art such as a coating weir is used to form a layer of coating composition or superimposed layers of several coating compositions. The distributor has a horizontal lip from which the layers detach to form a free-falling curtain. The instant invention consists of a trough adjacent and below this lip to intercept and collect some portion of the curtain and an edge guide to maintain the width of the passed portion of the free-falling curtain. The sidewall of the trough adjacent the main body of the curtain and passing through the plane of the curtain has a thin edge located immediately beneath the lip for severing the curtain; direct contact may damage the lip, and so a nominal clearance is maintained between the lip and severing edge. This sidewall extends downward and outward from the main body of the curtain at a substantial inclination from horizontal to sever and deflect the curtain. The coating composition intercepted by the trough proceeds through an outlet and may be recycled, sent to waste recovery, or discarded.

An edge guide begins at the severing edge of the trough and maintains the width of the free-falling curtain between the lip and the surface being coated. In the preferred embodiment of the invention, the edge guide consists of two thin, parallel and closely spaced wires under tension lying in a vertical plane perpendicular to the curtain. These wires are supported by the severing edge of the trough and continue inside the trough where their ends are held under tension. The trough and edge guide are attached to a positioning device for translation parallel to the lip. The width of the curtain and the coating can thereby be continuously varied.

Therefore, the apparatus for curtain coating comprises liquid supply means to deliver one or more coating compositions for simultaneous coating; liquid distribution means to create a layer or superimposed layers of said coating compositions; horizontal lip means from which said layer or superimposed layers detach to form a free-falling curtain; curtain-interception means containing a severing edge to intercept and divert a portion of said free-falling curtain comprising a solid, thin severing edge of thickness in the range 0.010–0.050 inches passing through the curtain immediately below said lip and a curved solid surface extending from said severing edge in a direction downward and away from the main body of said free-falling curtain such that the tangent at said severing edge at said lip is inclined from horizontal by an angle β between 20 and 45 degrees; edge-guide means for maintaining the width of said free-falling curtain between said lip at said severing edge and said receiving surface; and positioning means for translating together said curtain-interception means and said edge-guide means parallel to said lip; whereby the width of the coating on said receiving surface can be continuously adjusted without replacing or altering said liquid distribution means.

The method for coating comprises supplying liquid coating composition to liquid distribution means; distributing said composition by free-fall curtain coating; intercepting said curtain with curtain interception means containing a severing edge to direct composition which will not coat the receiving surface.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

Figure 1:
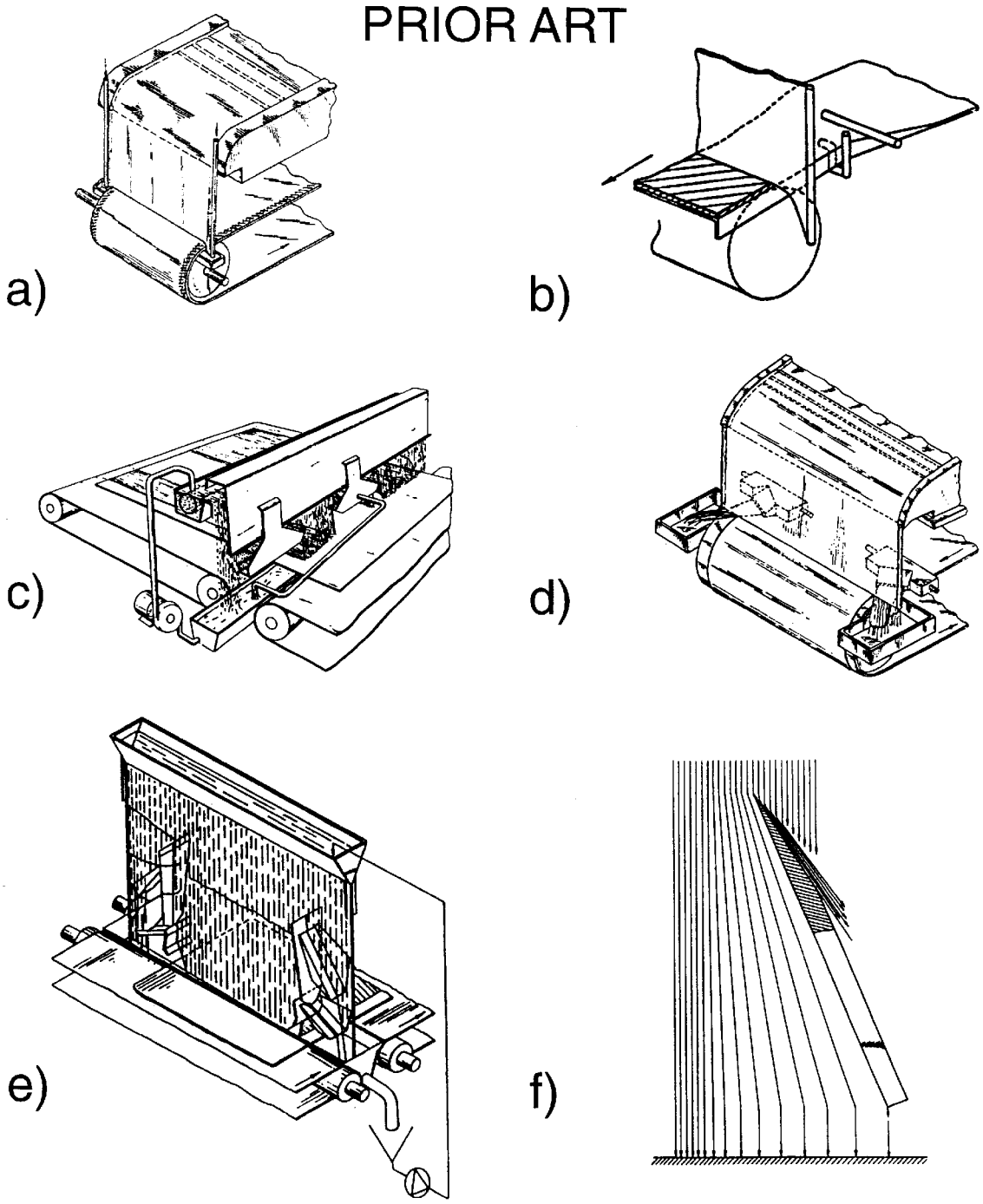
FIGS. 1*a–f* shows means for edging a curtain according to prior art.
Figure 2:
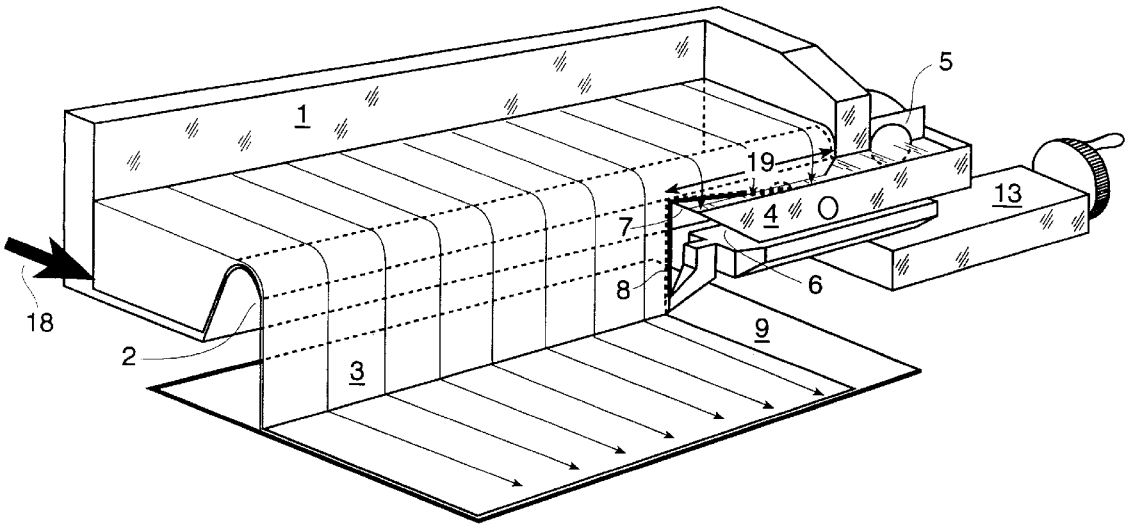
FIG. 2 is a perspective view of edging apparatus and flowing coating composition according to the invention.

As shown in FIG. 2, the distributor 1 known in the curtain-coating art is used to form one or more layers of coating composition. Delivery system 18 usually supplies the coating composition to the distributor through a conduit. A simple and inexpensive distributor for a single coating composition is a weir; coating composition overflowing a horizontal edge of the weir forms a layer. The use of weirs for curtain coating is taught, for example, in U.S. Pat. No. 4,060,649 and U.S. Pat. No. 3,205,089. A single layer can also be extruded from a die as in U.S. Pat. No. 5,298,288. Inside the die is one or more distribution cavities spanning the width of the curtain. Multiple distribution cavities are connected by passageways that are frequently slots spanning the width of the curtain. Usually the layer is extruded from a slot following the final distribution cavity. Several ways are known in the art to combine two or more such die elements to form superimposed layers for coating; for example, U.S. Pat. No. 3,508,947 and U.S. Pat. No. 4,384,015. Several slots may share a single exit. Alternatively, multiple slots may extrude onto inclined slide surfaces of the die so that flow continues by gravity, and layers are superimposed where slides and slot exits meet. All distributors for curtain coating have a horizontal lip or pouring edge where the flowing layers detach to form a free-falling curtain.

Figure 3:
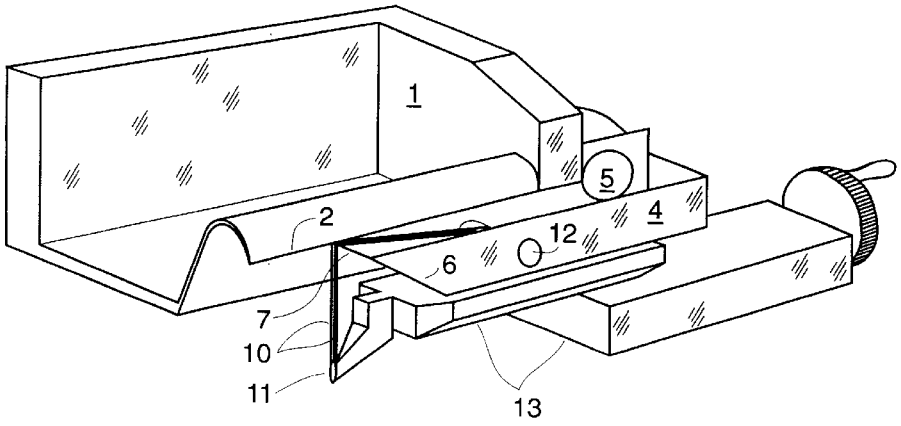
FIG. 3 is an enlarged perspective view of edging apparatus according to the invention.

FIG. 2 and FIG. 3 show a simple weir 1 with liquid supply means 18, although other distributors known in the art can be used to form the layer or layers of coating composition. The weir has horizontal lip means 2 where the layer detaches to form a free-falling curtain 3. Lips conducive to forming a uniform curtain are known in the art, for example U.S. Pat. No. 5,462,598.

Figure 4:
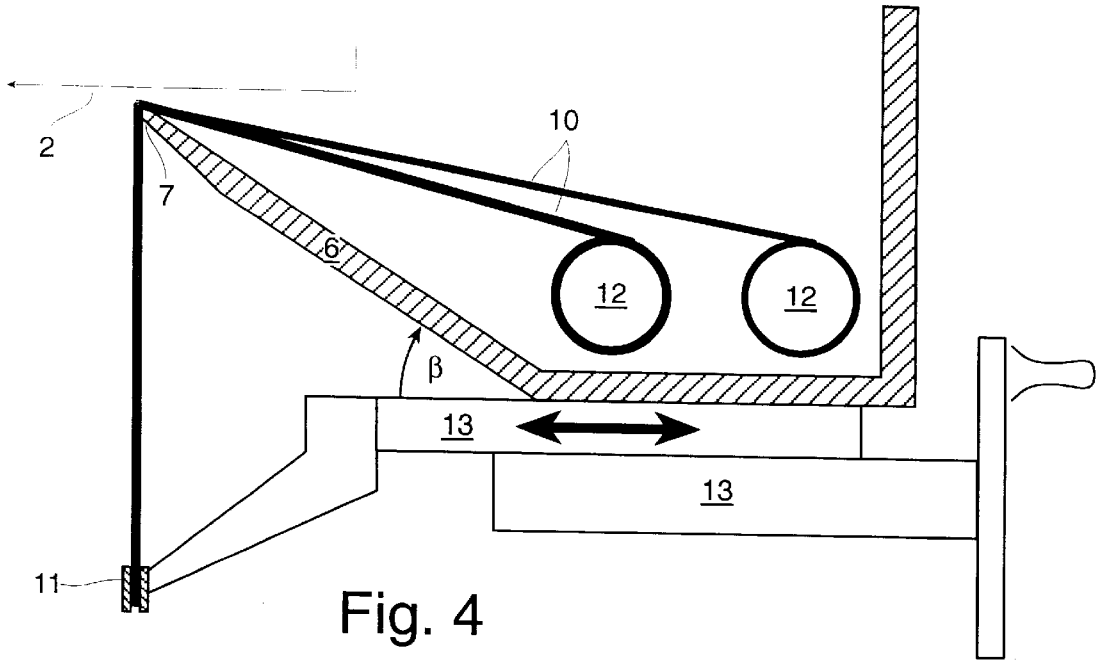
FIG. 4 is a cross section of the edging apparatus according to the invention in a vertical plane passing through the lip of the distributor.

A curtain interception means such as a trough 4 is positioned below the lip to intercept and collect a portion of the curtain that is not to be coated 19. The trough has an outlet 5 from which the collected coating composition exits. The sidewall 6 of trough 4 that is nearest the main body of the curtain intercepts and severs the curtain. To accomplish this, the top edge 7 of sidewall 6 is thin, being generally in the range 0.01–0.05 inches thick, and passes through the plane of curtain 3. Usually the top edge 7 is a severing edge and will be horizontal and perpendicular to the curtain, although this precise orientation is not essential. The sidewall 6 approaches the main body of the curtain at a substantial inclination from horizontal; if the inclination is too steep, the curtain may not sever, and if the inclination is too shallow, drainage into the trough is inefficient. The angle of inclination, β in FIG. 4, is generally in the range of 20–45 degrees, and 30 degrees is preferred.

An edge guide means 8 is used to maintain the width of the free-falling curtain between lip 2 and receiving surface 9. Many edge guides are known in the art, but a particularly advantageous guide comprises two thin, parallel wires 10 under tension (U.S. Pat. No. 5,328,726). The wires lie in a vertical plane perpendicular to lip 2; they are substantially vertical in that plane but may be angled slightly to follow the trajectory of the curtain; curtain trajectory and its relationship to the lip configuration are taught in U.S. Pat. No. 5,462,598. The wires are preferably metal for strength and wettability and may for example be tungsten or a stainless steel alloy. Preferably the wires are smooth, as a rough or braided surface may produce waves and concomitant flow redistribution in the curtain (see for instance, U.S. Pat. No. 4,060,649). Wire diameter is typically in the range of 0.005–0.01 inches. The gap between the wires is typically in the range 0.005–0.05 inches. The tension in the wires should be high enough, of the magnitude of 5 pounds force, that surface tension cannot draw the wires closer together.

Figure 5:
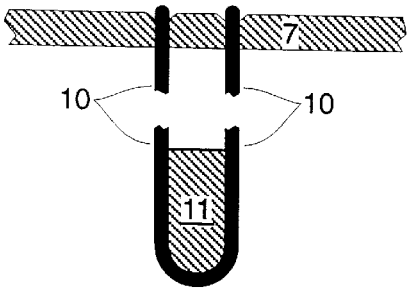
FIG. 5 is a cross section of the edging apparatus according to the invention in a vertical plane perpendicular to the lip of the distributor and coincident with the wetted surface of the edge guide.

The wires may be supported at the bottom of the edge guide by a grooved pin 11 as shown in FIG. 3; a continuous wire may follow the groove and wrap around the pin as shown in FIG. 5, in which case the tension in the wire holds it captive. The wires are advantageously supported at the top of the edge guide by the severing edge 7, which may be notched to locate the wires as shown in FIG. 5. Means to maintain the spacing of the wires include these notches, together with the grooved pin 11. The wires may wrap around severing edge 7 and continue to a means for tensioning and anchoring the wires. Most simply, the tensioning and anchoring means can be a bolt 12 as shown in FIG. 4 about which the wires wrap. Turning and locking the bolt tensions the wires. Preferably the wires have separate tensioning bolts, as shown in FIG. 4, because the tight turn in the wire at pin 11 can maintain a tension difference in the wires.

Figure 6:
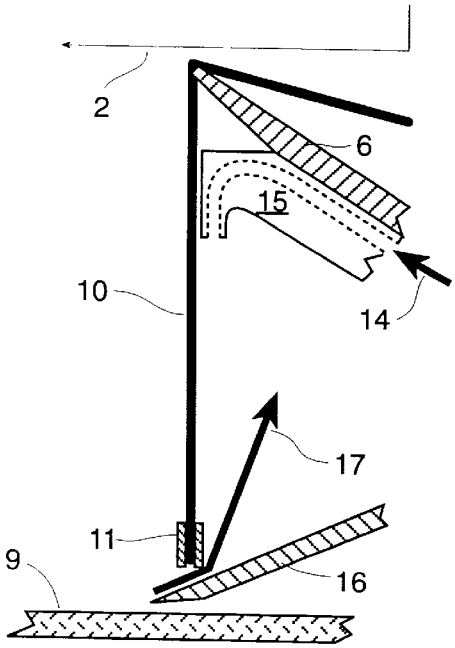
FIG. 6 is a cross section of the edging apparatus according to the invention in a vertical plane passing through the lip of he distributor showing the additional steps of introducing lubricating liquid to the edge guide and removing a portion of the curtain adjacent to the edge guide immediately above the receiving surface using blade and vacuum means.

The wire edge guide described here is simple and serves well in many cases. A less advantageous alternative is a single wire or rod, or the thin edge of a plate; the thickness of such guides in the vertical plane perpendicular to the lip should be in the range of 0.01 to 0.1 inches. In demanding conditions including low flow rate or high viscosity where the edge guide fails to hold the Curtain, continuously supplied lubricating liquid 14 shown in FIG. 6 of lower viscosity than the coating composition can be delivered to the edge guide near the lip by introduction means 15 as known in the art (e.g. U.S. Pat. No. 5,358,569) and as indicated in FIG. 6. Lubricating liquid is also advantageous if the coating composition tends to build up on the edge guide. In demanding conditions of high speed coating or inadequate drying capability for the very edges of the coating, a narrow section of the curtain may be intercepted immediately below pin 11 and immediately above receiving surface 9 and evacuated without introducing drag. Interception and evacuation means comprising a blade 16 and vacuum port 17, as taught in U.S. Pat. No. 5,395,660 and as indicated in FIG. 6, is particularly effective.

Trough 4 and edge guide 8 are attached to a positioning means 13 that translates them along and parallel to lip 2. This positioning device can simply be a platform driven by a screw turned by a manual crank as shown in the drawings. Motorized linear positioners are also readily obtainable. The width of the curtain can be varied continuously if desired; for example, a motorized positioner might be controlled by a signal from an optical sensor determining the position of the edge of the receiving surface.

EXAMPLE

A curtain two inches in height was formed using a weir and the edging method of the invention to apply an excess of subbing composition to a continuous web of polyethylene terephthalate backed by a roller and moving at 350 ft/min. The curtain was 2 inches in height and impinged on the web 45 degrees from the top of the roller in the direction of rotation. The thickness of the coating was controlled by a conventional air knife located on the other side of the roller. The subbing composition contained bone gelatin in water at 0.5% and Saponin surfactant at 0.01%. The severing edge of the trough was 0.05 inches thick, and the sidewall of the severing edge was inclined at 30 degrees to horizontal as preferred. The edge guide comprised two tungsten wires 0.006 inches in diameter and spaced 0.020 inches apart; no lubricating liquid or interception and evacuation means immediately above the web was needed in this application. Using a manually operated positioner for each of the two edge guides, curtain width could be changed by 5 inches to accommodate different web widths without altering or replacing the weir or the edging elements and without stopping the coating process. In addition, the adjustment provided by the instant invention allowed ⅛ inch wide portions at the edges of the web to remain unwetted by the curtain.

The invention has been described in detail with particular reference to certain preferred embodiments thereof, but it will be understood that variations and modifications can be effected within the spirit and scope of the invention.

| PARTS LIST | |
|---|---|
| 1 | distributor |
| 2 | lip means |
| 3 | coating curtain |
| 4 | trough |
| 5 | trough outlet |
| 6 | sidewall of trough |
| 7 | top edge of sidewall |
| 8 | edge guide |
| 9 | receiving surface |
| 10 | parallel edge guide wires |
| 11 | grooved pin |
| 12 | bolt |
| 13 | positioning means |
| 14 | lubricating liquid |
| 15 | lubricating liquid introducing means |
| 16 | blade |
| 17 | vacuum port |
| 18 | coating delivery system |
| 19 | position of composition not to be coated |

What is claimed is:

1. A curtain-coating apparatus for coating a plurality of layers onto portions of a receiving surface comprising:

liquid supply means to deliver one or more coating compositions for simultaneous coating;

liquid distribution means to create a layer or superimposed layers of said coating compositions;

horizontal lip means from which said layer or superimposed layers detach to form a free-falling curtain;

curtain-interception means containing a severing edge to intercept and divert a portion of said free-falling curtain comprising:

a solid, thin severing edge of thickness in the range 0.01–0.05 inches passing through the curtain immediately below said lip; and a solid surface extending from said severing edge in a direction downward and away from the main body of said free-falling curtain such that the tangent at said severing edge at said lip is inclined from horizontal by an angle β between 20 and 45 degrees;

edge-guide means for maintaining the width of said free-falling curtain between said lip at said severing edge and said receiving surface, said edge guide means extending down from said severing edge and being supported therefrom; and positioning means for translating together said curtain-interception means and said edge-guide means parallel to said lip;

whereby the width of the coating on said receiving surface can be continuously adjusted without replacing or altering said liquid distribution means.

2. Apparatus according to claim 1 wherein said angle β is 30 degrees.

3. Apparatus according to claim 1 wherein said curtain interception means is a trough comprising:

a sidewall continuing downward and outward from said curtain interception means;

an opposite sidewall positioned beyond the end of said lip;

front and back side walls positioned to enclose said intercepted and diverted portion of said free-falling curtain;

a bottom wall contiguous with said sidewalls; and an outlet means through which intercepted and diverted portions of said free-falling curtain exits said trough.

4. Apparatus according to claim 1 wherein the liquid supply means is a hopper.

5. Apparatus according to claim 1 wherein the liquid distribution means is a weir.

6. Apparatus according to claim 1 wherein said edge guide means comprises two parallel, tensioned wires or threads substantially vertical and lying in a vertical plane perpendicular to said lip, wherein said wires or threads are 0.005 to 0.010 inch in diameter and are spaced apart at 0.005 to 0.05 inches.

7. The method according to claim 1 wherein said edge guide means is a substantially vertical edge of a solid surface of thickness in the range 0.010–0.10 inches.

8. The apparatus according to claim 7 wherein said wires or threads are supported by said severing edge of said curtain-interception means.

9. Apparatus according to claim 1 wherein the positioning means is continuously adjustable.

10. A method for curtain coating a receiving surface comprising:

supplying liquid coating composition to liquid distribution means;

forming one or more substantially uniform superimposed liquid layers with said distribution means;

creating a free-falling curtain with horizontal lip means;

intercepting portions of said free-falling curtain below and adjacent said horizontal lip means with curtain interception means containing a severing edge passing through said free-falling curtain to divert composition which will not coat the receiving surface;

guiding an edge of said free-falling curtain between said severing edge and the receiving surface.

11. The method according to claim 10 further comprising the step of intercepting and removing an edge portion of said free-falling curtain immediately below the edge guide and immediately above said receiving surface.

12. The method according to claim 10 further comprising the step of issuing lubricating liquid onto the edge guide, said lubricating liquid having a viscosity less than any of the coating compositions.

13. The method according to claim 10 wherein said positioning means is continuously adjustable.

* * * * *